US006010129A

United States Patent [19]

Mochizuki et al.

[11] Patent Number: 6,010,129

[45] Date of Patent: Jan. 4, 2000

[54] SHEET STACK EJECTOR MECHANISM FOR SHEET SORTER

[75] Inventors: Naoto Mochizuki, Yamanashi-ken; Makoto Miyaki, Tokyo, both of Japan

[73] Assignees: Nisca Corporation, Yamanashi-ken, Japan; Riso Kagaku Corporation, Tokyo, Japan

[21] Appl. No.: 08/855,393

[22] Filed: May 13, 1997

[30] Foreign Application Priority Data

May 13, 1996 [JP] Japan ..... 8-117514

[51] Int. Cl.[7] ..... B65H 39/10; B65H 33/04

[52] U.S. Cl. ..... 271/299; 271/296; 271/303; 271/177; 270/58.17; 270/58.18

[58] Field of Search ..... 271/296, 299, 271/303, 177, 300, 302, 224, 221; 270/58.18, 58.17, 58.16, 58.13, 58.12, 58.26, 58.27

[56] References Cited

U.S. PATENT DOCUMENTS

| | | | |
|---|---|---|---|
| 2,561,754 | 2/1951 | Gaffron | 271/294 |
| 3,638,937 | 2/1972 | Schulz et al. | 271/290 |
| 3,774,906 | 11/1973 | Fagan et al. | 271/289 |
| 5,080,342 | 1/1992 | Mori et al. | 270/58.11 |
| 5,390,910 | 2/1995 | Mandel et al. | 271/292 |
| 5,449,167 | 9/1995 | Takehara et al. | 271/296 |
| 5,499,811 | 3/1996 | Hayashi et al. | 271/293 |
| 5,632,479 | 5/1997 | Kubota et al. | 271/296 |
| 5,857,670 | 1/1999 | Jung | 270/58.12 |
| 5,890,050 | 3/1999 | Kaneda | 270/58.18 |

FOREIGN PATENT DOCUMENTS 4-43089 2/1997 Japan .

*Primary Examiner*—Donald P. Walsh
*Assistant Examiner*—Daniel K. Schlak
*Attorney, Agent, or Firm*—Sixbey, Friedman, Leedom & Ferguson, PC; Donald R. Studebaker

[57] ABSTRACT

A sheet sorter includes a plurality of bins arranged in a vertical direction each of which receives a plurality of sheets discharged from an image recording apparatus and forms thereon a stack of sheets. A sheet transfer mechanism transfers the sheets discharged from the image recording apparatus, and an indexer receives the sheets from the sheet transfer mechanism and distributes the sheets to the respective bins through the sheet inlet ends. A sheet stack ejector mechanism ejects the stack of sheets on each of the bins beyond the sheet inlet end of the bin by a predetermined length, thereby giving a stapler access to the stack of sheets. The ejector mechanism includes a guide rail which extends in a vertical direction through the bins, and a sheet stack ejector member which is mounted on the guide rail to be movable up and down along the guide rail and is adapted to eject the stacks of sheets on the respective bins one by one toward the stapler.

10 Claims, 13 Drawing Sheets

SHEET STACK EJECTOR MECHANISM FOR SHEET SORTER

BACKGROUND OF THE INVENTION

1. Field of the Invention

This invention relates to a sheet stack ejector mechanism for a sheet sorter, and more particularly to a sheet stack ejector mechanism for use in a sheet sorter, which is provided with a plurality of bins each of which receives a plurality of sheets discharged from an image recording apparatus such as a printer, a copier or the like and forms thereon a stack of sheets, in order to eject the sheet stack on each bin toward a post handling mechanism such as a punch, a stapler or the like which is movable up and down along the array of the sheet inlet ends of the bins.

2. Description of the Related Art

As disclosed, for instance, in Japanese Unexamined Patent Publication No. 4(1992)-43089, there has been known a sheet sorter in which a plurality of recorded sheets discharged from an image recording apparatus such as a printer, a copier or the like are distributed to a plurality of bins or sort trays in sequence to form a stack of sheets on each bin by a sheet distributor called an indexer and when the number of the sheets stacked on each of the bins reaches a predetermined value, the sheet stack on each of the bins is stapled by a stapler which is movable up and down along the array of the sheet inlet ends of the bins and in a horizontal direction along the edge of each bin.

Accordingly when stapling the sheet stack, it is necessary to eject the sheet stack on a selected one of the bins toward the stapler. For this purpose, conventionally, each bin is arranged to be movable toward the stapler and the selected bin is moved toward the stapler to bring the sheet stack thereon to the stapler, or a sheet stack ejector is provided for each of the bins.

However with the arrangement where each of the bins is movable toward the stapler, provision to prevent interference between the bin and the stapler must be made. Further either of the conventional structures complicates the structure of the sorter and its drive system.

Further, in the case where each bin is provided with an ejector, it becomes difficult for the ejector to eject the sheet stack on the bin when the bin is deflected or deformed.

SUMMARY OF THE INVENTION

In view of the foregoing observations and description, the primary object of the present invention is to provide a sheet stack ejector mechanism for a sheet sorter which is simple in structure.

Another object of the present invention is to provide a sheet stack ejector mechanism for a sheet sorter in which it is not necessary to provide an ejector for each of the bins.

Still another object of the present invention is to provide a sheet stack ejector mechanism for a sheet sorter which can eject the sheet stack on each bin even if the bin is deformed or deflected.

The sheet stack ejector mechanism in accordance with the present invention is for use in a sheet sorter, comprising a plurality of bins arranged in a vertical direction each of which receives a plurality of sheets discharged from an image recording apparatus and forms thereon a stack of sheets, a sheet transfer means which transfers the sheets discharged from the image recording apparatus, an indexer which receives the sheets from the sheet transfer means and is movable up and down along the array of sheet inlet ends of the bins to distribute the sheets to the respective bins through the sheet inlet ends thereof, and a post handling means which is movable up and down along the array of the sheet inlet ends of the bins and carries out a predetermined post handling on the stack of sheets on each of the bins, in order to eject the stack of sheets on each of the bins beyond the sheet inlet end of the bin by a predetermined length, thereby giving the post handling means access to the stack of sheets.

The sheet stack ejector mechanism of the present invention comprises a guide rail which extends in a vertical direction through the bins, and a sheet stack ejector member which is mounted on the guide rail to be movable up and down along the guide rail and is adapted to eject the stacks of sheets on the respective bins one by one toward the post handling means.

The post handling means may comprise a stapler which binds the stack of sheets.

It is preferred that the guide rail be movable toward the sheet inlet ends of the bins and the sheet stack ejector member be projected from the guide rail toward the sheet inlet ends by a distance not smaller than said predetermined length.

Said guide rail may double as a stopper which abuts against the leading edge of the sheet fed into the bin by the indexer and stops the sheet.

It is preferred that the sheet stack ejector member be engaged with a surface of each bin and ejects the stack of sheets on the bin toward the post handling means under the guidance of the surface of the bin, and at the same time the sheet stack ejector member be movable up and down along the guide rail in a position where the sheet stack ejector member is disengaged from the surface of the bin.

In this case, it is preferred that the sheet stack ejector member ejects the stack of sheets on the bin toward the post handling means held between adjacent bins.

The sheet stack ejector may be provided with a stopper which abuts against the leading edge of the sheet fed into the bin by the indexer and stops the sheet separately from said guide rail.

In the sheet stack ejector mechanism of this invention, since the sheet stack ejector adapted to eject the stacks of sheets on the respective bins one by one toward the post handling means is mounted for up-and-down movement on the guide rail which extends through the bins, the bins may be kept stationary and it is not necessary to provide a sheet stack ejector for each bin, whereby the sheet sorter and its drive system may be very simple in structure.

When the guide rail is movable toward the sheet inlet end of the bin and the sheet stack ejector is projected toward the sheet inlet end by a distance not smaller than said predetermined length from the guide rail, only the stack of sheets on a selected bin can be ejected from the sheet inlet end of the bin by the predetermined length by bringing the sheet stack ejector into alignment with the selected bin and moving the guide rail toward the sheet inlet end of the bin.

Further when the guide rail is movable toward the sheet inlet end of the bin, the guide rail may be arranged to function also as a stopper of the sheet and/or a member for lining up the sheets. In this case, the sheet stack ejector member is moved upward or downward to its retracted position when the guide rail functions as a stopper of the sheet and/or a member for lining up the sheets.

When the sheet stack ejector member is arranged to eject the stack of sheets on the selected bin toward the post handling means while moving toward the post handling means under the guidance of the surfaces of the adjacent bins held therebetween, the sheet stack ejector member can be moved along the bin even if the bins have been deformed or deflected, whereby the stack of sheets can be surely ejected.

DESCRIPTION OF THE PREFERRED EMBODIMENT

Figure 1:
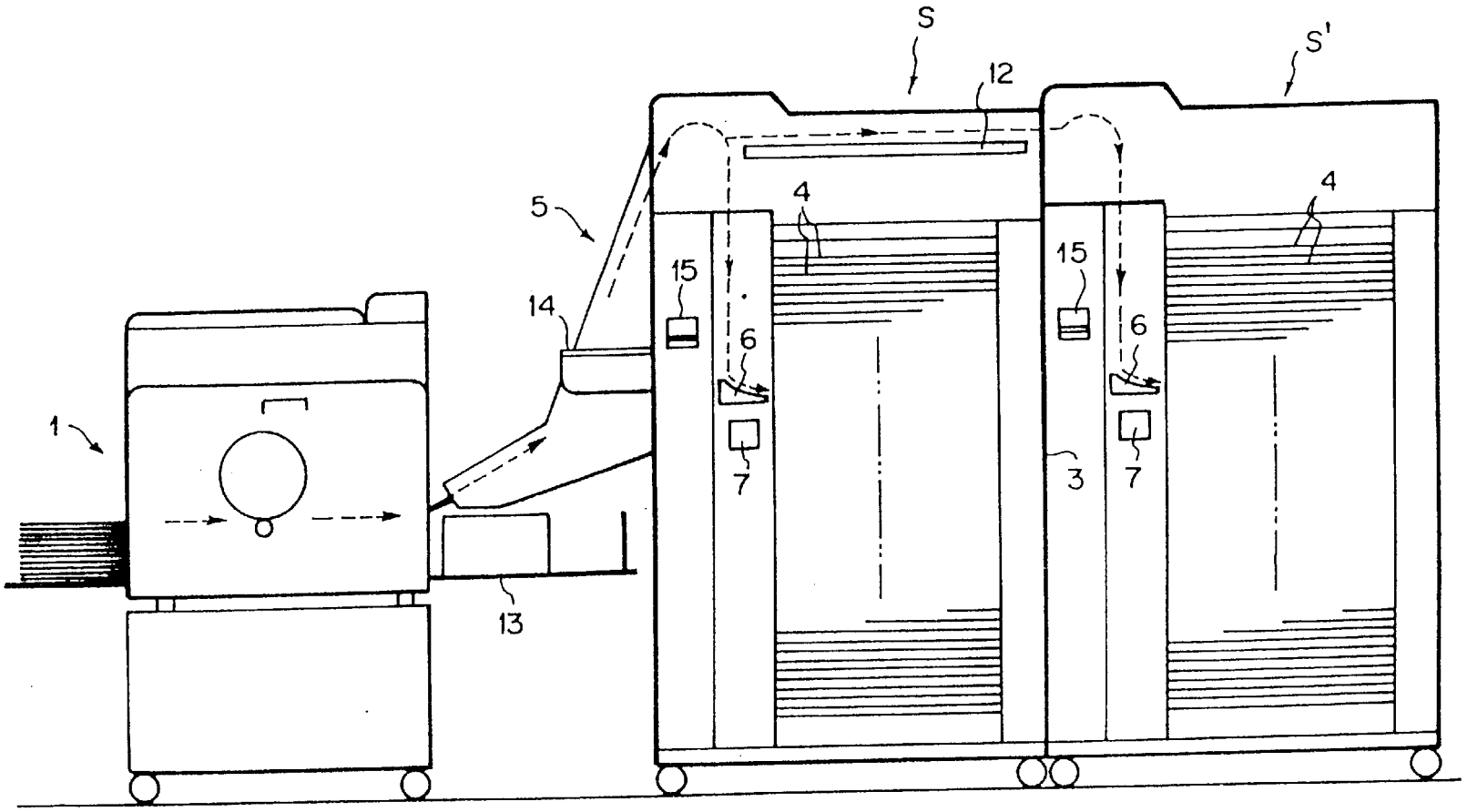
FIG. 1 is a schematic side view showing a sheet sorter provided with a sheet stack ejector mechanism in accordance with a first embodiment of the present invention with the sorter connected to an image recording apparatus.
Figure 2:
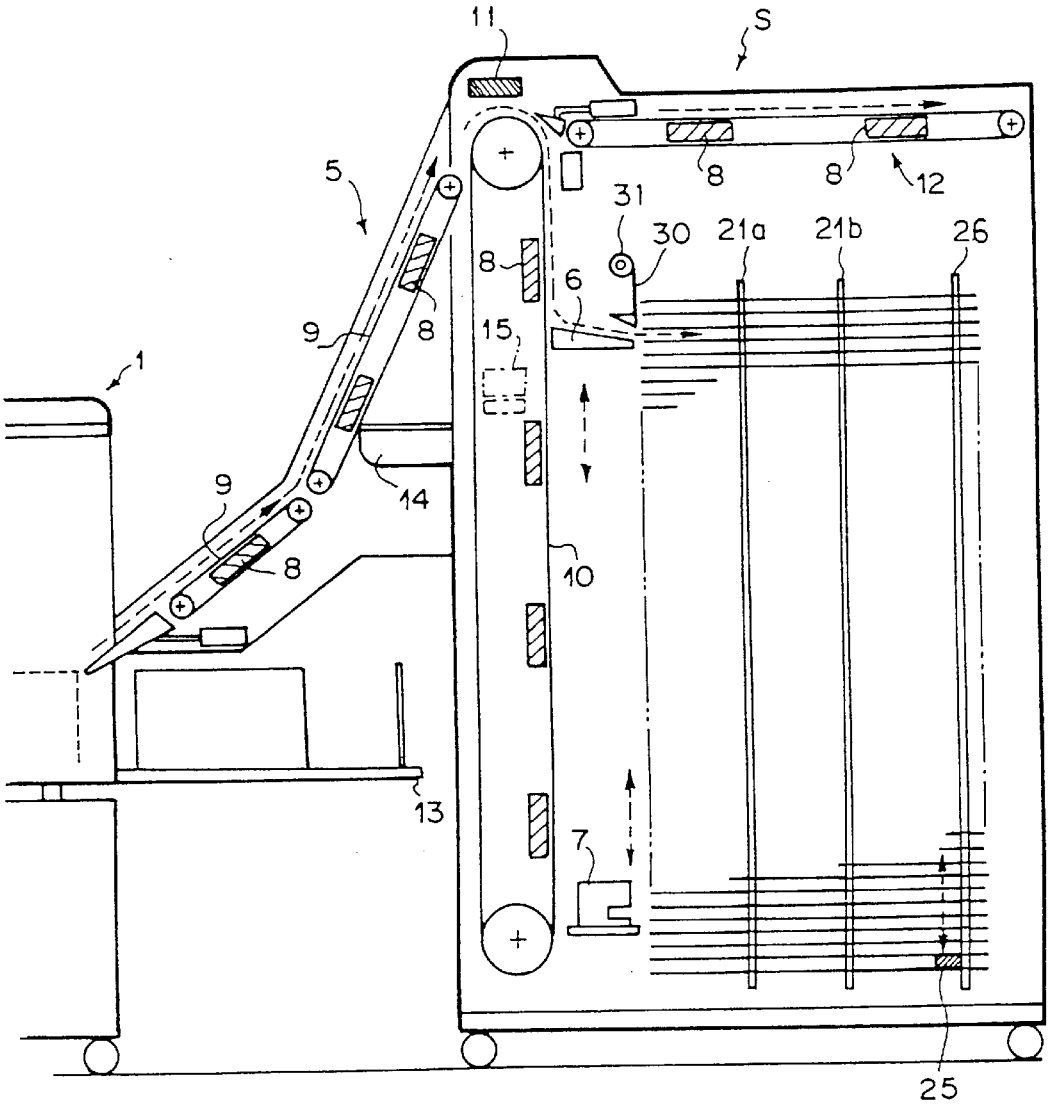
FIG. 2 is a side through-view showing the internal structure of the sorter shown in FIG. 1.

In FIGS. 1 to 4, a sheet sorter S comprises a plurality of (e.g., fifty) bins (sort trays) 4 which are disposed in fixed positions in a frame 3 at predetermined intervals in the vertical direction and receive a plurality of recorded sheets 2 (FIG. 3) discharged from an image recording apparatus 1 such as a printer to form a stack of the sheets 2 on each bin 4, a sheet transfer means 5 which transfers the sheets 2 discharged from the image recording apparatus 1 toward the bins 4, an indexer 6 which is movable up and down along the array of the sheet inlet ends 4*a* of the bins 4 and distributes the sheets 2 transferred by the sheet transfer means 5 to the respective bins 4, and a stapler 7 which is movable up and down along the array of the sheet inlet ends 4*a* of the bins 4 and in a horizontal direction along the edge of the sheet inlet end 4*a* of each bin.

In the case where the image recording apparatus 1 is a printer, especially a stencil printer, a number of sheets can be printed in a short time and recorded sheets 2 carrying thereon wet ink are discharged at a high rate. Accordingly no conveyor roller is used in the sheet transfer means 5 and the sheet transfer means 5 comprises perforated conveyor belts 9 and 10 which convey the sheets 2 with the back side of the sheets 2 attracted against the belts 9 and 10 under vacuum applied by blowers 8 and a fan 11 which presses the sheets 2 against the belt 10 under an air pressure as clearly shown in FIG. 2.

In this particular embodiment, the sheet sorter S is arranged so that a plurality of slaves S' having the same structure as the main sheet sorter S can be connected to the sheet sorter S as shown in FIG. 1 in order to increase the total number of the bins 4. The slaves S' are connected to the main sheet sorter S on the side remote from the image recording apparatus 1. A sheet conveyor 12 is demountably mounted on an upper portion of the main sheet sorter S and the sheets 2 in the main sheet sorter S are transferred to the slaves S' by the sheet conveyor 12 when the slaves S' are connected to the main sheet sorter S.

The image recording apparatus 1 is provided with a sheet tray 13 on which the discharged sheets 2 are stacked when sorting of the sheets 2 is not necessary. Further a control panel 14 and an exterior electric stapler 15 are mounted on the outer surface of the sheet sorter S.

Figure 3:
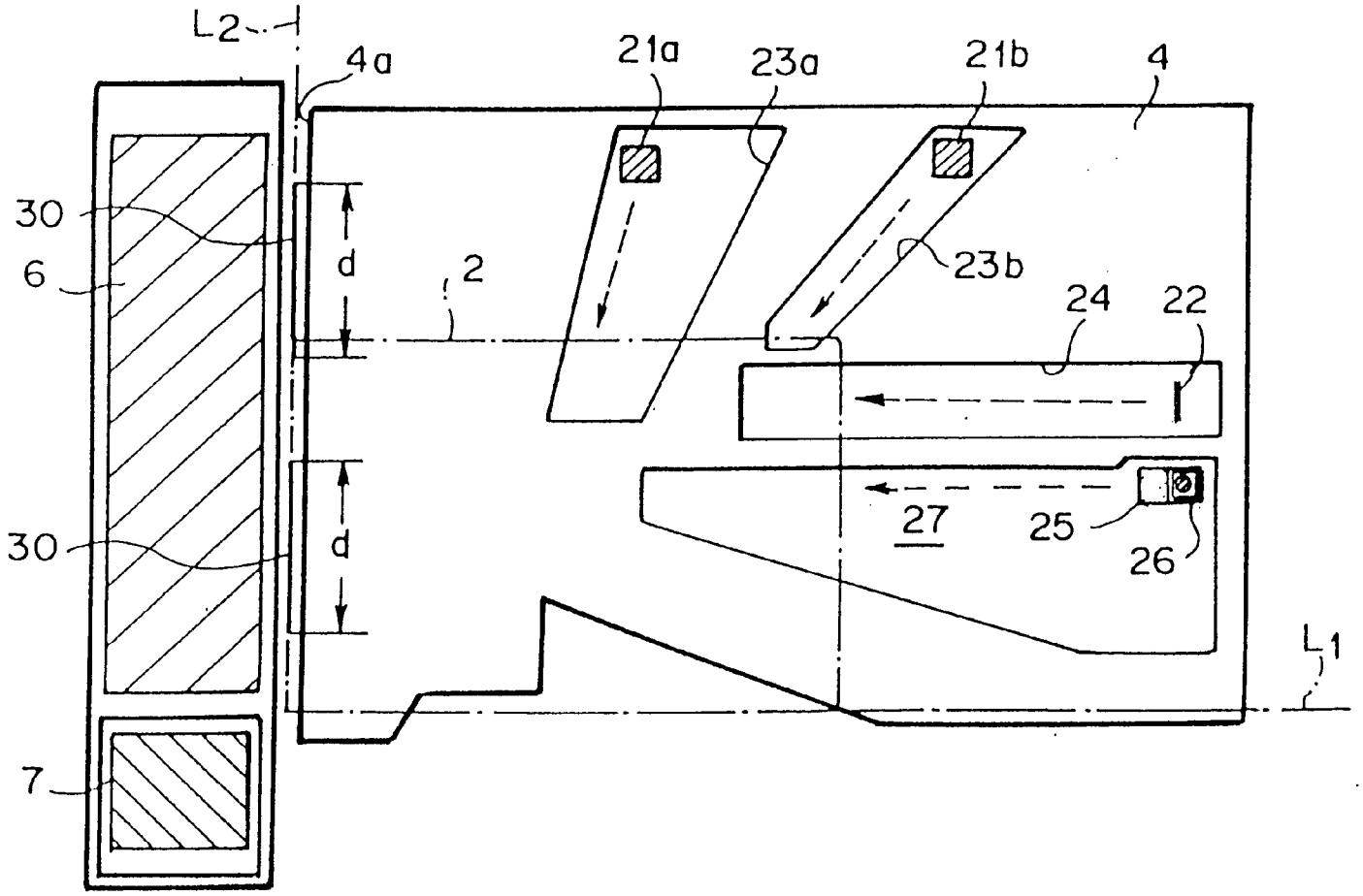
FIG. 3 is a schematic plan view showing the arrangement of the bins, indexer, stapler, sheet stack ejector and the like in the sorter shown in FIG. 1.

As shown in FIG. 3, the stapler 7 waits beside the path of the indexer 6 while the indexer 6 is moving up and down. The position in which the stapler 7 waits is such that the indexer 6 is brought into alignment with the stapler 7 in a horizontal direction when the indexer 6 is moved to a position where it can distribute a sheet 2 to the lowermost bin 4.

Figure 4:
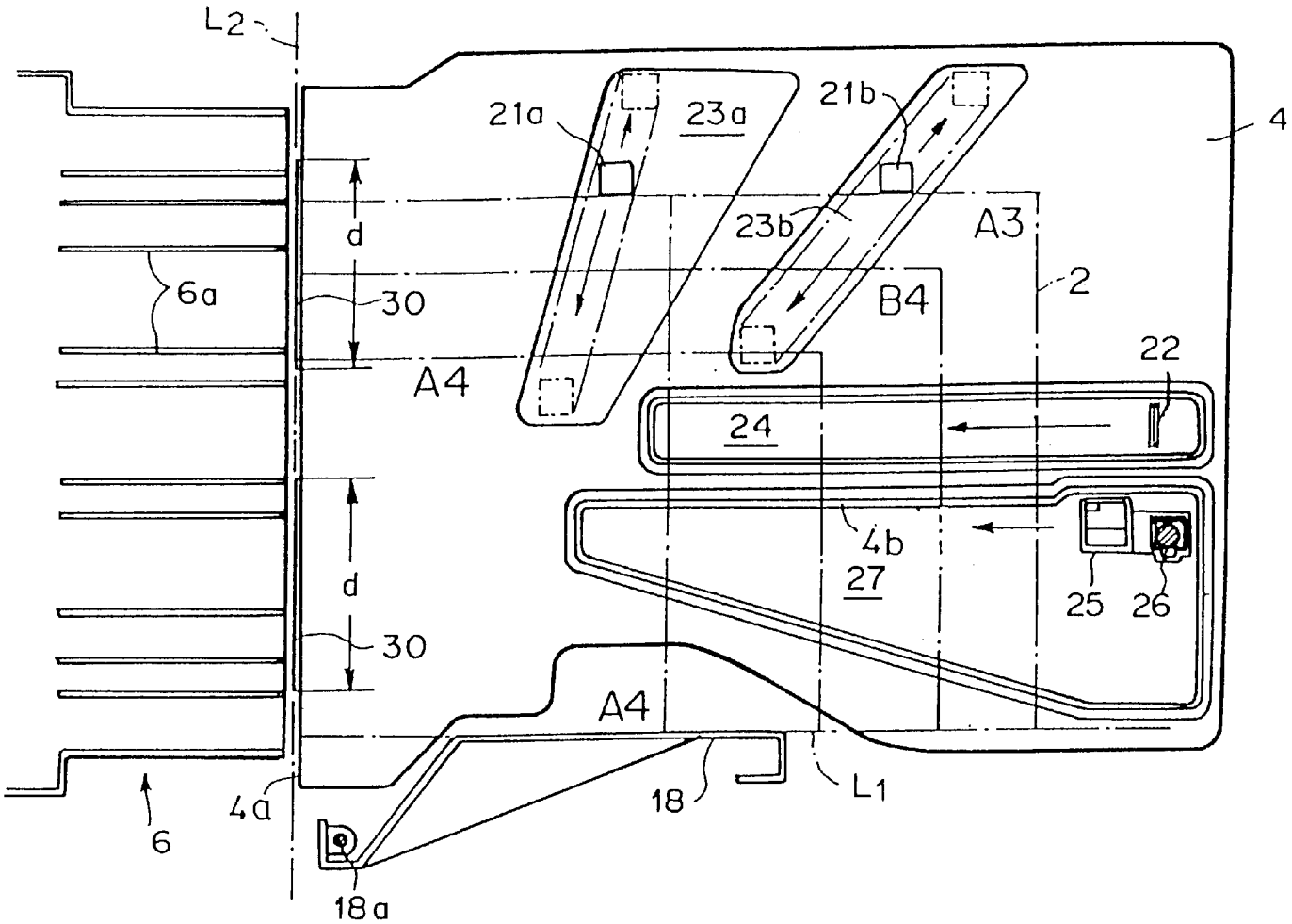
FIG. 4 is an enlarged view of an important part of FIG. 3.

As shown in FIG. 4, side edges of the sheets 2 placed on each bin 4 are lined up along a side edge reference surface L1 defined by the inner surface of a sheet stack take-out door 18 which is rotatable about a pin 18*a*. For this purpose, there vertically extend through the plurality of bins 4 a pair of side lineup rods 21*a* and 21*b* which push the sheet 2 in the direction of width of the sheet 2 and bring the side edge of the sheet 2 into abutment against the side edge reference surface L1, a stopper member 22 of a resilient material such as rubber band against which the leading edge of the sheet 2 is brought into abutment when the leading edge is released into the bin 4 at a high speed from the indexer 6, thereby gently stopping the sheet 2, and a guide rail 26 along which a sheet stack ejector 25 (to be described later) is moved up and down.

The side lineup rods 21*a* and 21*b* and the stopper member 22 are moved respectively along slots 23*a*, 23*b* and 24. The stopper member 22 is moved along the slot 24 left and right as seen in FIG. 3 by a distance according to the size of the sheets 2 to be released from the indexer 6.

The guide rail 26 doubles as a lineup rod which pushes the leading edge of the sheet 2 to move the sheet 2 toward the sheet inlet end 4*a* of the bin 4 so that the trailing edge of the sheet 2 is brought into abutment against a trailing edge reference surface L2. For this purpose, the guide rail 26 is provided with a flat vertical surface 26*a* facing toward the sheet inlet end 4*a* of the bin 4. The guide rail 26 is movable left and right as seen in FIG. 3 in an opening 27 formed in the bin 4.

As shown in FIG. 4, the side lineup rods 21*a* and 21*b* are movable at angles to the direction in which the sheet 2 is fed into the bin 4 so that they are simultaneously moved toward and away from both the reference surfaces L1 and L2 and can act on various sizes of the sheets 2. Further the angle at which the path of the side lineup rod 21*b*, which is at a larger distance from the trailing edge reference surface L2, is inclined to the feeding direction of the sheet 2 is smaller than that of the other side lineup rod 21*a*, and accordingly as the rods 21*a* and 21*b* are moved toward the side edge of the sheet 2, the distance between the rods 21*a* and 21*b* becomes smaller.

After completion of distribution of the sheets 2 to all the bins 4 by the indexer 6, the sheet stacks 20 (FIG. 6) on the respective bins 4 are ejected, in sequence for stapling operation, beyond the trailing edge reference surface L2 into the path along which the indexer 6 is moved up and down. For this purpose, a sheet stack ejector 25 is provided. The sheet stack ejector 25 is movable in the opening 27 of the respective bins 4 along the guide rail 26 which vertically extends through the bins 4.

Referring also to FIGS. 5 to 11, the guide rail 26 is in the form of a hollow post rectangular in cross-section and the sheet stack ejector 25 comprises a base 40 which is mounted on the guide rail 26 to be movable up and down along the outer surface of the guide rail 26, a body portion 43 which is resiliently supported on the base 40 to be movable up and down with respect to the base 40 by way of a pin 41 and a pair of coiled springs 42 and is in the form a box open upward, and a movable portion 45 which is incorporated in the body portion 43 to be movable up and down with respect to the body portion 43. The movable portion 45 is urged upward by a coiled spring 44 compressed between the body portion 43 and the movable portion 45. The coiled spring 44 is stronger than the coiled springs 42.

Figure 7:
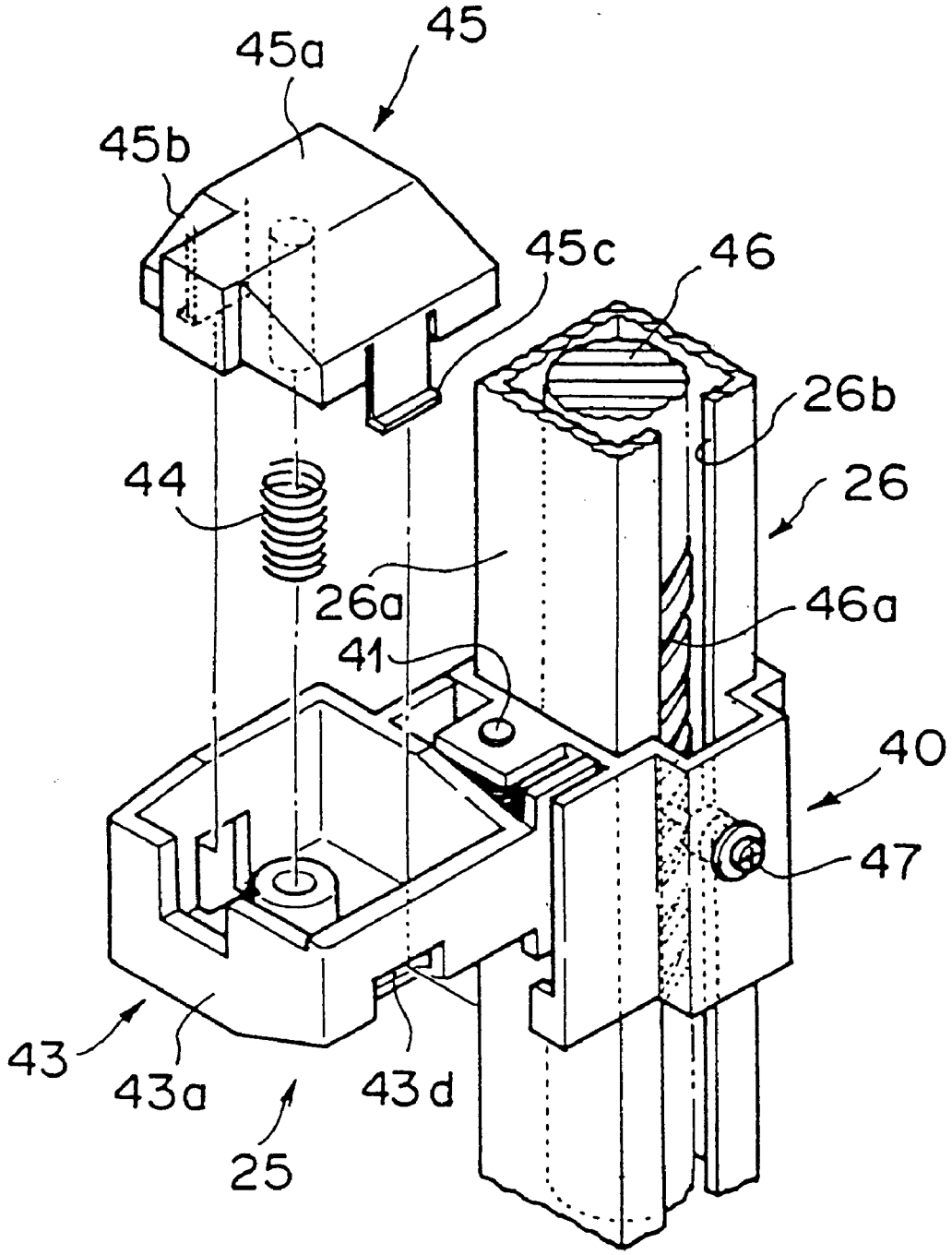
FIG. 7 is an exploded perspective view of the sheet stack ejector.

A screw rod 46 extends through the guide rail 26 to be rotatable about its longitudinal axis. The guide rail 26 is provided with a slot 26*b* which is formed in one side wall of the guide rail 26 to extend in the longitudinal direction thereof as shown in FIG. 7. A pin 47 fixed to the base 40 of the sheet stack ejector 25 extends through the slot 26*b* of the guide rail 26 and is in mesh with the thread 46*a* of the screw rod 46. Accordingly when the screw rod 46 is rotated in one direction, the sheet stack ejector 25 is moved upward along the guide rail 26 and when the screw rod 46 is rotated in the other direction, the sheet stack ejector 25 is moved downward along the guide rail 26.

Figure 9:
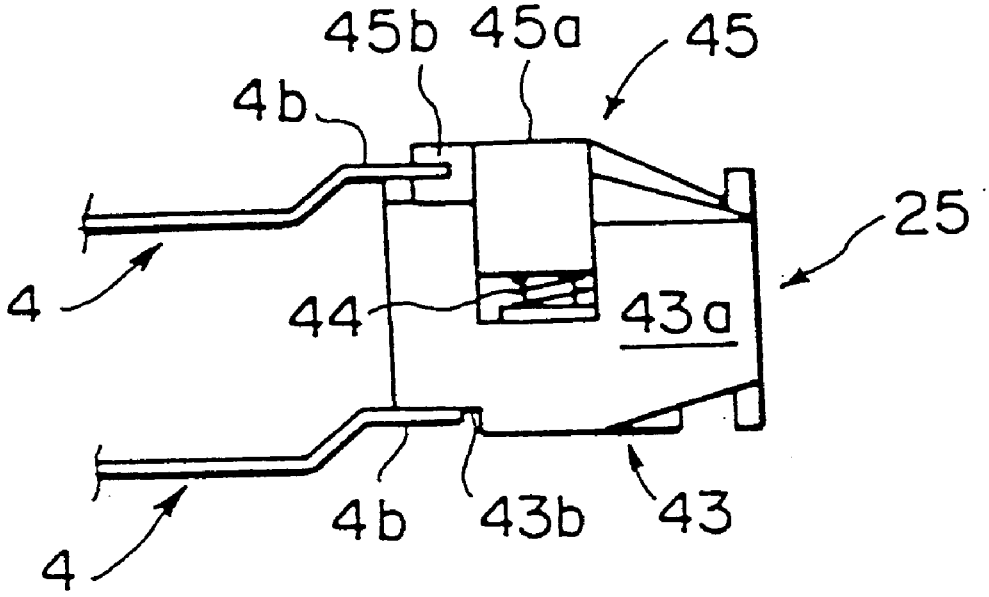
FIG. 9 is a fragmentary front view showing the state where the sheet stack ejector is free from the edge portion of the opening of the bin.
Figure 11:
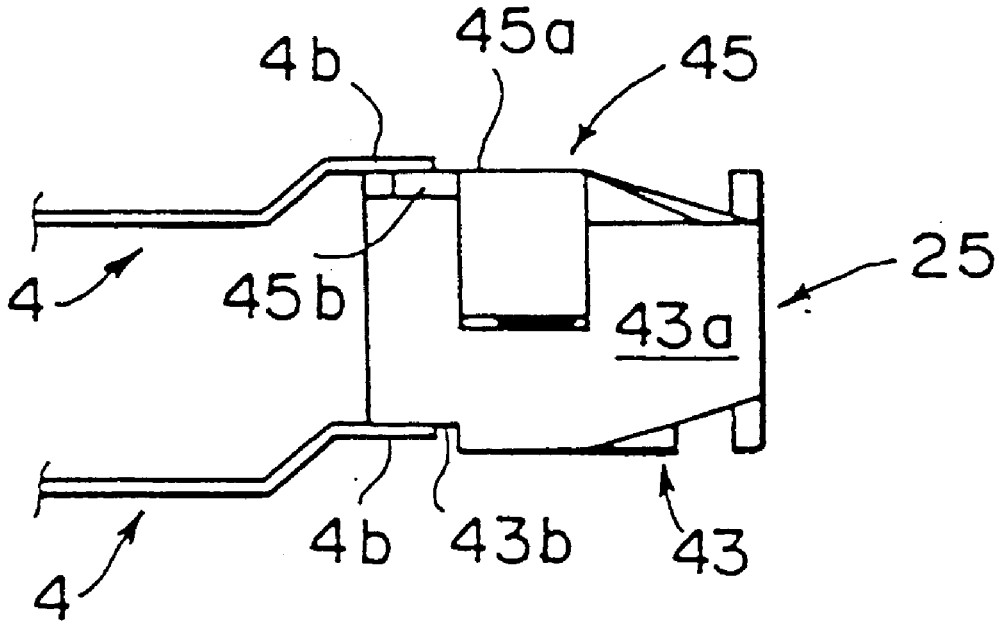
FIG. 11 is a fragmentary front view showing the state where the sheet stack ejector is in engagement with the edge portion of the opening of the bin.

As shown in FIGS. 4, 9 and 11, the opening 27 of each bin 4 is surrounded by an elevated edge portion 46 having a flat and horizontal top surface. The top surface of the elevated edge portion 46 of the opening 27 is elevated from the bottom of the bin 4 by a predetermined amount and the sheets 2 fed to the bin 4 rest on the top surface of the elevated edge portion 46 of the opening 27.

Figure 5:
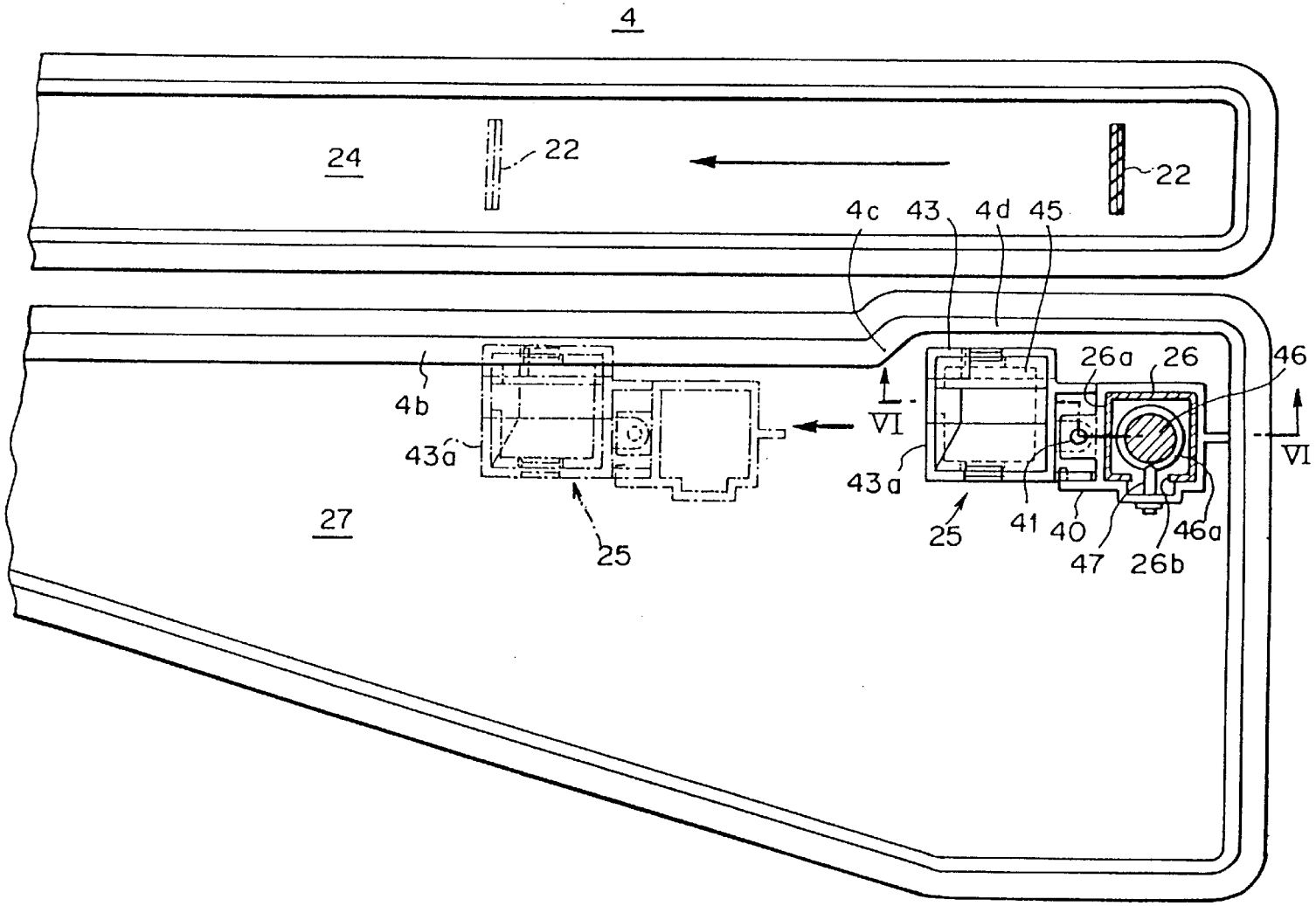
FIG. 5 is an enlarged view of the part of the bin where the stopper member, the sheet stack ejector and the guide rail are provided.

As shown in FIG. 5, the part of the elevated edge portion of the opening 27 extending along the path of the sheet stack ejector 25, along which the sheet stack ejector 25 is moved when ejecting the sheet stack 20, comprises an engagement portion 4*b* which projects into the path of the sheet stack ejector 25 and linearly extends in the direction of the path so that the sheet stack ejector 25 is moved toward the sheet inlet end 4*a* of the bin 4 in engagement with the engagement portion 4*b*, a retracted portion 4*d* which is positioned away from the path of the sheet stack ejector 25 and an oblique intermediate portion 4*c* connecting the engagement portion 4*b* and the retracted portion 4*d*. When the guide rail 26 is in the rightmost position shown by the solid line in FIG. 5, the sheet stack ejector 25 is opposed to the retracted portion 4*d* of the elevated edge portion and accordingly is free from the elevated edge portion so that the sheet stack ejector 25 can be moved up and down along the guide rail 26.

The movable portion 45 of the sheet stack ejector 25 has a flat top surface 45*a*, an inclined surface 45*b* which is inclined downward from the top surface 45*a* and faces toward the sheet inlet end 4*a* of the bin 4, and a pair of resilient engagement pieces 45*c* (only one of them is shown) which are engaged with engagement portions 43*d* of the body portion 43 to be described later to keep the movable portion 45 on the body portion 43.

The body portion 43 of the sheet stack ejector 25 has a flat and vertical abutment surface 43*a* which faces toward the sheet inlet end 4*a* of the bin 4 and is brought into abutment against the sheet stack 20 when ejecting the same, a flat and horizontal engagement surface 43*b* facing downward, and an inclined guide surface 43*c* (FIG. 6) which is inclined upward from the front (as seen in the direction of travel of the sheet stack ejector 25 when ejecting the sheet stack 20) edge of the engagement surface 43*b*. The body portion 43 is further provided with a pair of engagement portions 43*d* (FIG. 7) which are engaged with the engagement pieces 45*c* of the movable portion 45 when the movable portion 45 is forced into the body portion 43 from above, thereby keeping the movable portion 45 on the body portion 43 with the coiled spring 44 compressed therebetween. Thus the movable portion 45 is supported for up and down movement on the body portion 43 while urged upward by the coiled spring 44.

When the sheet stack 20 on one of the bins 4 is to be stapled, the sheet stack 20 on the bin 4 must be ejected from the sheet inlet end 4*a* of the bin 4 by a predetermined length, and accordingly the abutment surface 43*a* of the body portion 43 of the sheet stack ejector 25 is positioned at a distance not smaller than the predetermined length from the vertical surface 26*a* of the guide rail 26. When the guide rail 26 brings the trailing edges of the sheets 2 into alignment with each other on a trailing edge reference surface L2, the sheet stack ejector 25 is moved upward or downward along the guide rail 26 to a position where the sheet stack ejector 25 does not interfere with the lineup operation of the guide rod 26.

Figure 6:
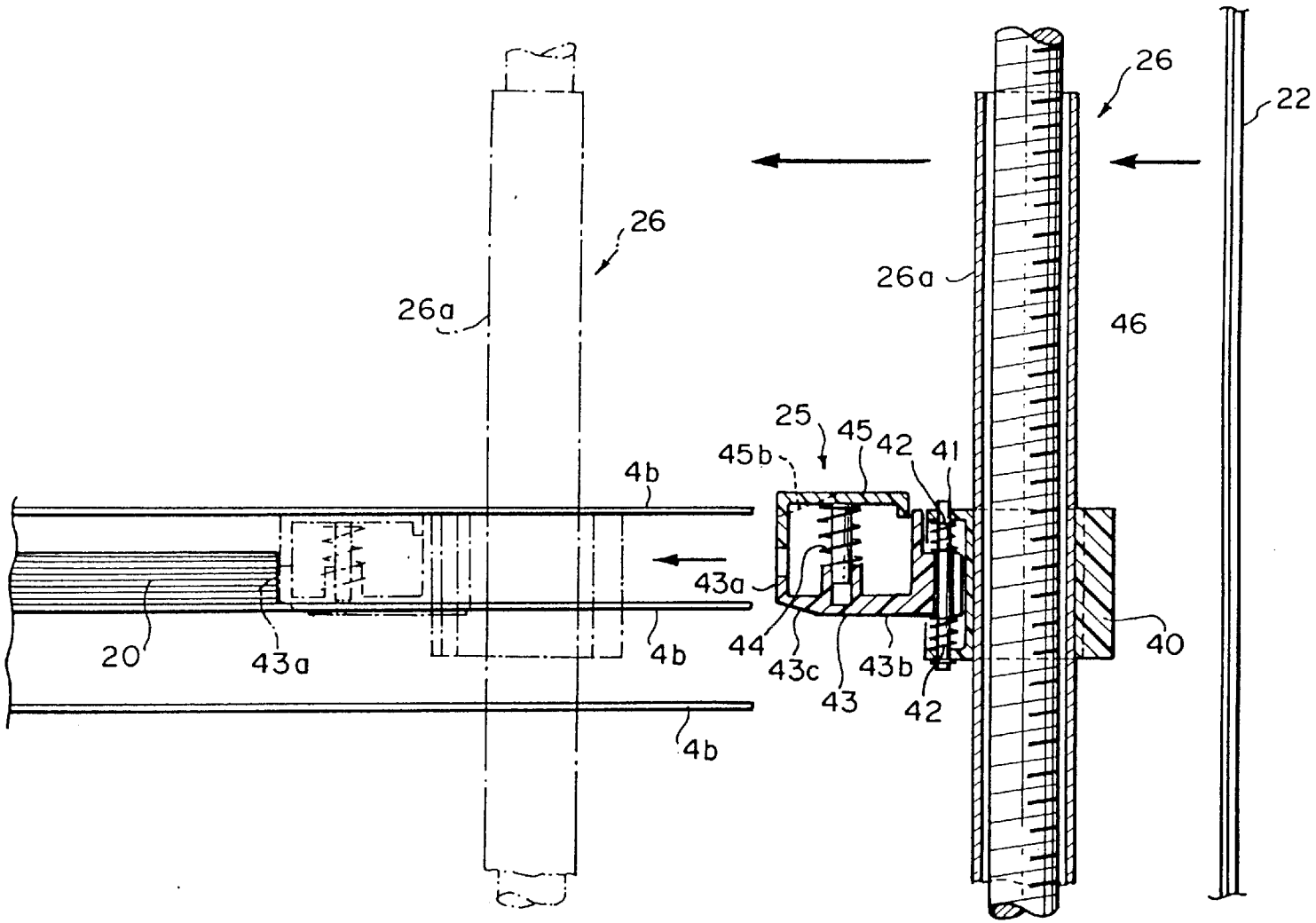
FIG. 6 is a cross-sectional view taken along line VI—VI in FIG. 5.
Figure 8:
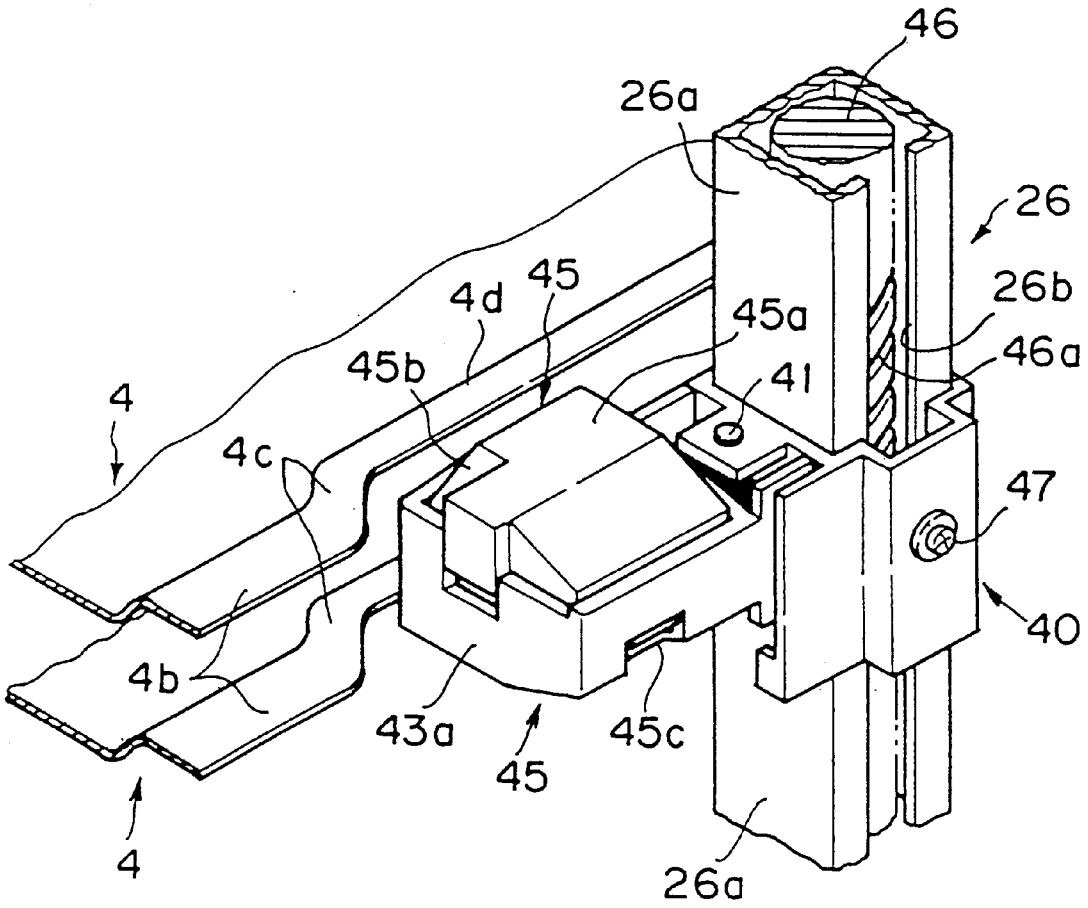
FIG. 8 is a fragmentary perspective view showing the state where the sheet stack ejector is free from the edge portion of the opening of the bin.
Figure 10:
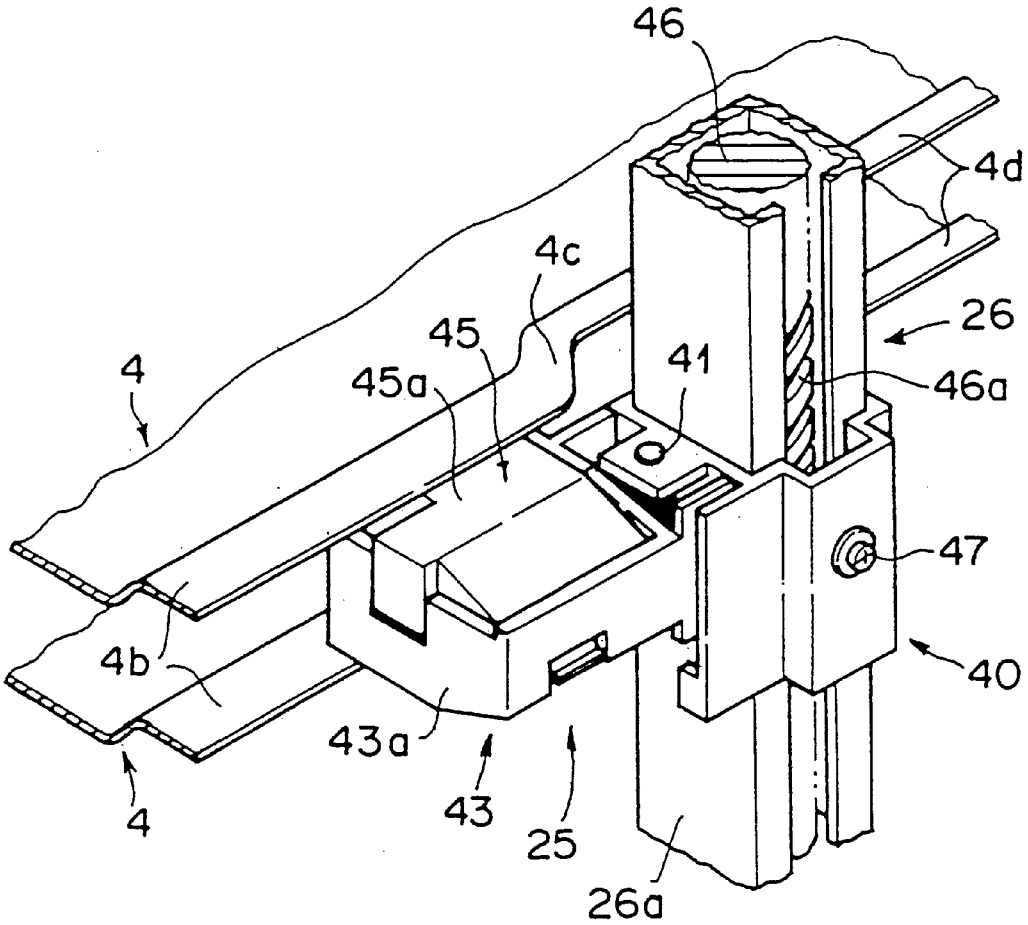
FIG. 10 is a fragmentary perspective view showing the state where the sheet stack ejector is in engagement with the edge portion of the opening of the bin.

When ejecting the sheet stack 20 on a selected bin 4, the sheet stack ejector 25 is first moved along the guide rail 26 to a predetermined position suitable for ejecting the sheet stack 20 on the bin 4 and the guide rail 26 is moved toward the sheet inlet end 4*a* of the bin 4 from the position shown in FIGS. 5, 6 and 8. As the guide rail 26 is moved toward the sheet inlet end 4*a*, the inclined guide surface 43*c* of the body portion 43 of the sheet stack ejector 25 comes to be engaged with the upper surface of the intermediate portion 4*c* of the elevated edge portion of the opening 27 of the selected bin 4 and at the same time the inclined surface 45*b* of the movable portion 45 comes to be engaged with the lower surface of the intermediate portion 4*c* of the elevated edge portion of the opening 27 of the bin 4 just above the selected bin 4. Accordingly as the guide rail 26 is moved further forward, the level of the sheet stack ejector 25 is adjusted by resiliency of the springs 42 and the engagement surface 43*b* of the body portion 43 comes to be resiliently engaged with the upper surface of the engagement portion 4*b* of the elevated edge portion of the selected bin 4 while the top surface 45*a* of the movable portion 45 comes to be resiliently engaged with the lower surface of the engagement portion 4*b* of the elevated edge portion of the bin 4 just above the selected bin 4 under the strong resilient force of the spring 44 as shown in FIGS. 10 and 11. Thus the sheet stack ejector 25 ejects the sheet stack 20 on the selected bin 4 toward the stapler 7 while moving toward the stapler 7 under the guidance of the surfaces of the engagement portions 4*b* of the adjacent bins 4 held therebetween.

Accordingly even if the bins 4 have been deformed or deflected, the sheet stack ejector 25 can be moved along the deflected or deformed bin 4, whereby the sheet stack 20 can be surely ejected.

Though, in this embodiment, the guide rail 26 doubles as a lineup rod for bringing the trailing edges of the sheets 2 into alignment with each other on the reference surface L2 and the stopper member 22 is provided separately from the guide rail 26, the guide rail 26 may be arranged to further double as the stopper member.

Otherwise, a lineup rod may be provided in the position of the stopper member 22 to double as the stopper member. In this case, it is preferred that the lineup rod be provided with a resilient member on the surface facing the sheet inlet end 4*a* of the bin 4 in order to gently stop the sheets 2. Further a resilient stopper member similar to the stopper member 22 employed in this embodiment may be provided at a distance from the lineup rod toward the sheet inlet end 4*a* of the bin 4 instead of providing a resilient member on the lineup rod.

Figure 12:
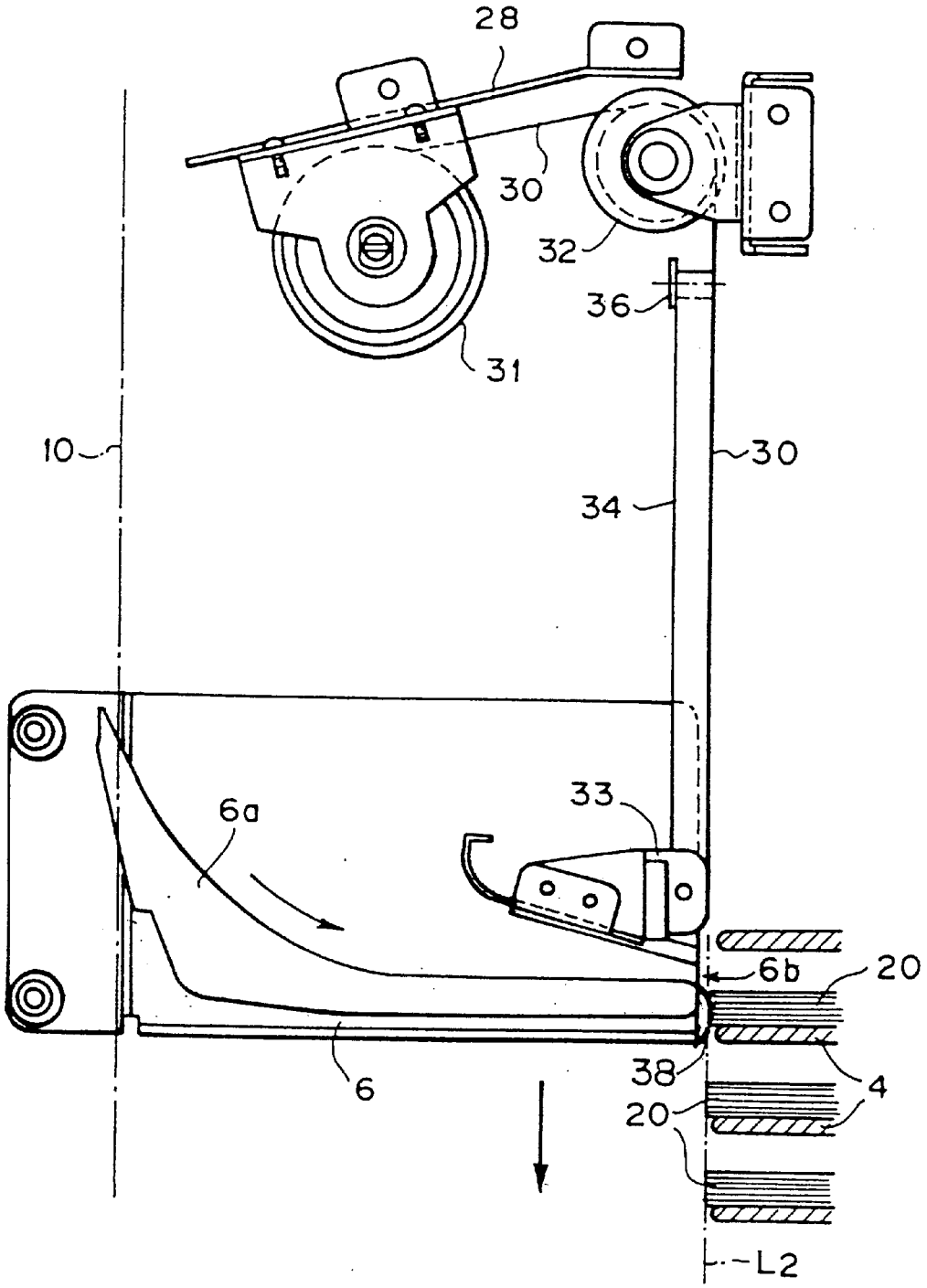
FIG. 12 is a side view showing the member for defining the trailing edge reference surface.
Figure 13:
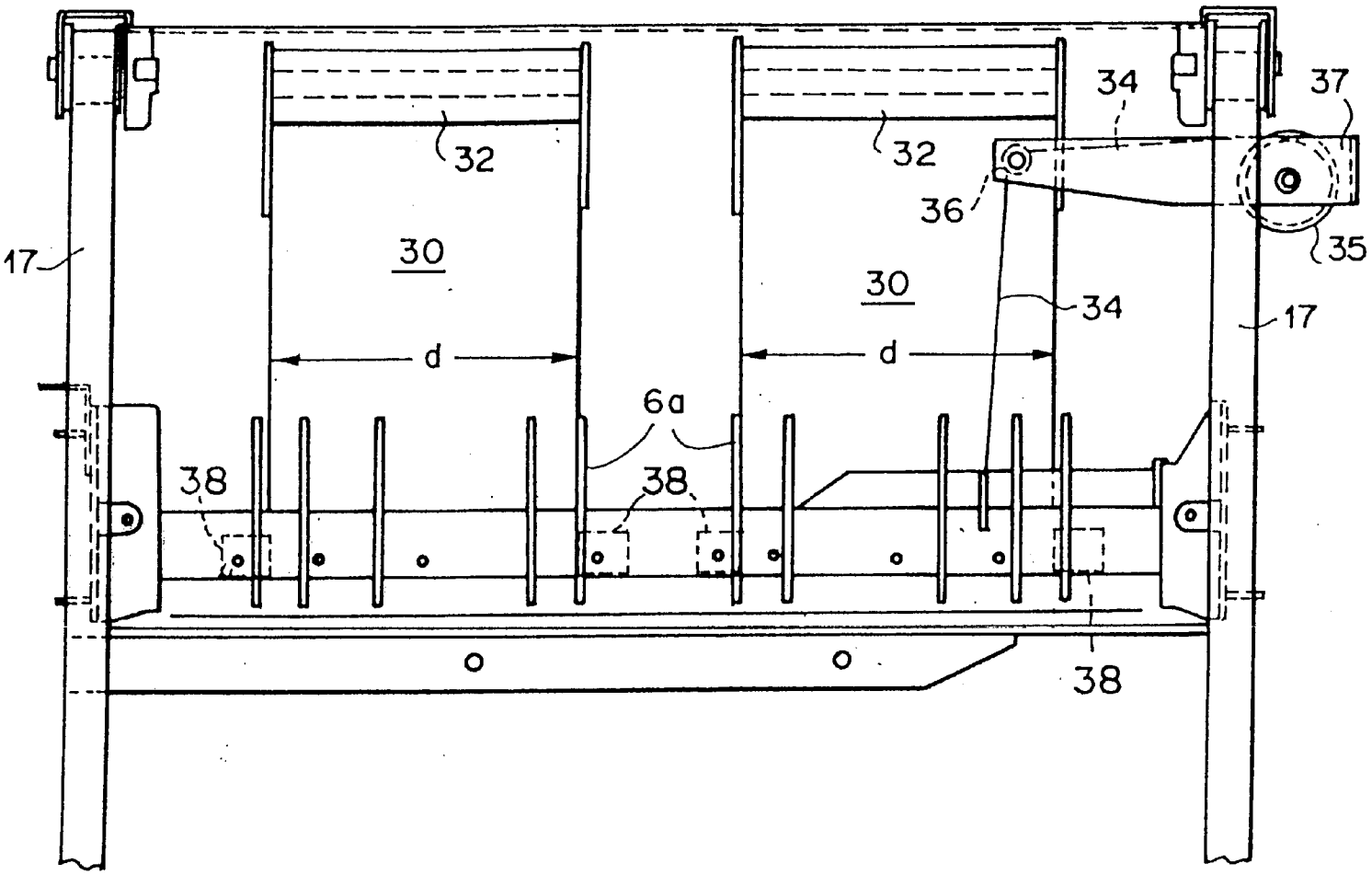
FIG. 13 is a front view as seen from the indexer side showing the same.

FIGS. 12 and 13 show a member for defining the reference surface L2. As shown in FIGS. 12 and 13, the indexer 6 has a plurality of sheet guide ribs 6*a* and is driven by endless belts 17 (FIG. 13) up and down along the array of the sheet inlet ends 4*a* of the bins 4.

The trailing edge reference surface L2 extends along the array of the sheet inlet ends 4*a* of the bins 4 and is defined by a pair of strip-like spring members 30 each having a width d as shown in FIGS. 4 and 13. The spring member 30 is in a continuous length and fed out from a roll in a casing 31 (FIG. 12) which is fixed to the frame 3 by way of a bracket 28. The part of the spring member 30 extending outside the casing 31 is passed around a reel 32 and extends right downward. The leading end of the spring member 30 is fixed to a fixing member 33 which is provided just above the sheet discharge port 6*b* of the indexer 6 close thereto.

Accordingly the spring members 30 are long fed out from the casing 31 as the indexer 6 moves downward and close the sheet inlet ends 4*a* of the bins 4 which are above the sheet discharge end 6*b* of the indexer 6, thereby forming the trailing edge reference surface L2. As the indexer 6 moves upward the spring members 30 are taken up into the casing 31.

In this particular embodiment, a second strip-like spring member 34 which is smaller than the spring member 30 in width is employed to reinforce the spring member 30, thereby holding flat the spring member 30. That is, the second spring member 34 is in a continuous length and fed out from a roll in a casing 35 which is fixed to the frame 3 by way of a bracket 37 so that the longitudinal axis of the casing 35 is substantially perpendicular to that of the casing 31 of the spring member 30. The part of the second spring member 34 extending outside the casing 35 is passed around a reel 36 and extends downward with its one side edge in contact with the indexer side surface of the spring member 30 substantially perpendicularly thereto. The leading end of the second spring member 34 is fixed to the indexer 6 at a portion above the sheet discharge port 6*b* of the indexer 6.

Also the second spring member 34 is fed out from the casing 35 as the indexer 6 moves downward and taken up into the casing as the indexer 6 moves upward. For instance, the second spring member 34 may be of a constant load spring such as "Conston®".

Further in this particular embodiment, as a means for assisting the spring members 32 in lining up the trailing edges of the sheets 2 in the sheet stack 20, hollow resilient members 38 are mounted on the indexer 6 below the sheet discharge port 6*b* on opposite sides of each spring member 20. The hollow resilient members 38 is formed of, for instance, "Mylar®". Each resilient member 38 arcuately bulges toward the bin 4 and has an inclined surface which presses the trailing edge of the sheet stack 20 toward the guide rail 26.

The operation of the sheet sorter S with the arrangement described above will be described, hereinbelow.

(1) First the indexer 6 is located in a position where the sheet discharge port 6*b* thereof is opposed to the sheet inlet end 4*a* of the uppermost bin 4 with the stapler 7 held in the waiting position beside the path of the indexer 6. At this time, the side lineup rods 21*a* and 21*b* are held in the respective retracted positions at a maximum distance from the side edge reference surface L1 and the stopper 22 is held in a position corresponding to the size of the sheets 2 to be discharged from the image recording apparatus 1. Further the guide rail 26 is held in the position shown in FIGS. 4 and 5 with the sheet stack ejector 25 held in the opening 27 of the lowermost bin 4.

(2) Assuming that the image recording apparatus 1 prints forty documents each of twenty pages, the image recording apparatus 1 first discharges forty sheets 2 of page 20. Accordingly, while moving downward, the indexer 6 distributes one sheet 2 of page 20 to each bin 4 up to the fortieth bin 4 as numbered from above. The sheet 2 released into each bin 4 slides on the bin 4 and is stopped by the stopper member 22.

(3) At the time distribution of the sheets 2 of page 20 to the forty bins 4 is completed, the sheet inlet end 4*a* of the fortieth bin 4 is kept open though the sheet inlet ends 4*a* of the first (uppermost) to thirty-ninth bins 4 have been closed by the spring members 30. Accordingly, the indexer 6 is further moved downward by a small distance, thereby closing the sheet inlet end 4*a* of the fortieth bin 4 by the spring members 30.

(4) Thereafter the side lineup rods 21*a* and 21*b* are moved toward both the reference surfaces L1 and L2, thereby bringing the side edge of the sheet 2 in each bin 4 into alignment with the reference surface L1 while the guide rail 26 is moved toward the sheet inlet ends 4*a* of the bins 4, thereby bringing the trailing edge of the sheet 2 in each bin 4 into abutment against the spring members 30 or into alignment with the reference surface L2.

(5) Then the indexer 6 is returned upward to the position where the sheet discharge port 6*b* thereof is opposed to the sheet inlet end 4*a* of the uppermost bin 4 and distributes one sheet 2 of page 19 to each bin 4 up to the fortieth bin 4 to be superposed on the sheet 2 of page 20 in the similar manner. In this manner, a sheet stack 20 of sheets 2 of pages 1 to 20 is formed on each of the first to fortieth bins 4.

(6) Each time the indexer 6 is moved upward, the inclined surfaces of the hollow resilient members 38 are brought into contact with the trailing edges of the sheet stacks 20 on the respective bins 4 in sequence, thereby lining up the trailing edges of the sheets 2 in each stack 20.

(7) When formation of a sheet stack 20 of sheets 2 of pages 1 to 20 on each of the first to fortieth bins 4 is thus completed, the guide rail 26 is returned to the position shown in FIG. 5. Further the indexer 6 is moved upward beyond the position shown in FIG. 12 so that the sheet inlet ends 4*a* of all the bins 4 are opened.

(8) Thereafter the stapler 7 in the waiting position is moved in a horizontal direction into the path of the indexer 6 and then moved upward to a position where the throat of the stapler 7 is positioned in a predetermined position for stapling the sheet stack 20 in the fortieth bin 4, and at the same time, the screw rod 46 in the guide rail 26 is rotated to bring the sheet stack ejector 25 into the opening 27 of the fortieth bin 4. Thereafter the guide rail 26 is moved toward the sheet inlet end 4*a* of the bin 4 so that the sheet stack ejector 25 ejects the sheet stack 20 on the fortieth bin 4 beyond the reference surface L2 by a predetermined length, whereby the trailing edge of the sheet stack 20 is inserted into the throat of the stapler 7. That the trailing edge of the sheet stack 20 is in the throat of the stapler 7 is detected by a detector (not shown) and the stapler 7 automatically staples the sheet stack 20.

(9) Thereafter the guide rail 26 is returned to the original position together with the sheet stack ejector 25 and a pusher (not shown) provided on the stapler 7 pushes the stapled sheet stack 20 into the bin 4.

(10) Then the stapler 7 is moved upward to a position where the throat of the stapler 7 is opposed to the sheet stack 20 in the thirty-ninth bin 4, and at the same time, the screw rod 46 in the guide rail 26 is rotated to bring the sheet stack ejector 25 into the opening 27 of the thirty-ninth bin 4. Thereafter the guide rail 26 is moved toward the sheet inlet end 4*a* of the bin 4 so that the sheet stack ejector 25 ejects the sheet stack 20 on the thirty-ninth bin 4 beyond the reference surface L2 by a predetermined length, whereby the trailing edge of the sheet stack 20 is inserted into the throat of the stapler 7. Then the stapler 7 automatically staples the sheet stack 20 and the guide rail 26 is returned to the original position together with the sheet stack ejector 25 and the pusher on the stapler 7 pushes the stapled sheet stack 20 into the bin 4.

(11) In this manner, the sheet stacks 20 on all the bins 4 are stapled and after completion of the stapling operation, the stapler 7 is returned to the waiting position. Then the sheet stack take-out door 18 is opened and the stapled sheet stacks are taken out.

Though the stapling operation is started from the sheet stack 20 on the lowermost bin 4 in the embodiment described above, the stapling operation may be started from the sheet stack 20 on the uppermost bin 4 after the stapler 7 is once moved to the uppermost bin 4.

As can be understood from the description above, in the sheet stack ejector mechanism of this embodiment, since the sheet stack ejector 25 adapted to eject the sheet stacks 20 on the respective bins 4 one by one toward the stapler 7 is mounted for up-and-down movement on the guide rail 26 which extends through the bins 4, the bins 4 may be kept stationary and it is not necessary to provide a sheet stack ejector for each bin, whereby the sheet sorter S and its drive system may be very simple in structure.

Further since the guide rail 26 is movable toward the sheet inlet end 4*a* of the bin 4 and the sheet stack ejector 25 is projected toward the sheet inlet end 4*a* by a distance not smaller than said predetermined length from the guide rail 26, only the sheet stack 20 on a selected bin 4 can be ejected from the sheet inlet end 4*a* of the bin 4 by the predetermined length by bringing the sheet stack ejector 25 into alignment with the selected bin 4 and moving the guide rail 26 toward the sheet inlet end 4*a* of the bin 4.

Further since the sheet stack ejector 25 ejects the sheet stack 20 on the selected bin 4 toward the stapler 7 while moving toward the stapler 7 under the guidance of the surfaces of the engagement portions 4*b* of the adjacent bins 4 held therebetween, the sheet stack ejector 25 is moved along the bin 4 even if the bins 4 have been deformed or deflected, whereby the sheet stack 20 can be surely ejected.

Further by virtue of the spring members 30 which are fed out and taken up in response to up-and-down movement of the indexer 6 and defines the trailing edge reference surface L2, the trailing edges of the sheets 2 can be precisely aligned with each other on the reference surface L2 without providing each bin 4 with a vertical surface defining the trailing edge reference surface as in conventional systems.

Further since the spring members 30 defining the trailing edge reference surface L2 are taken up into the casing 31 as the indexer 6 moves upward, all the bins 4 are free from any member which closes the sheet inlet ends 4*a* so long as the indexer 6 is in its uppermost position and accordingly ejecting the sheet stacks 20 beyond the sheet inlet ends 4*a* and returning the same into the bins 4 are greatly facilitated.

Further the strip-like spring member 34 whose side edge is brought into contact with the indexer side surface of the spring member 30 substantially perpendicularly thereto reinforces the spring member 30 which defines the trailing edge reference surface L2 and improves the flatness of the spring member 30. At the same time, since the spring member 34 is fed out and taken up into the casing 35 in response to the up-and-down movement of the indexer 6, the spring member 34 does not interfere with the movement of the spring member 30.

Further since the side lineup rods 21*a* and 21*b* which push the sheets 2 in the direction of width to bring the side edges of the sheets 2 into abutment against the side reference surface L1, thereby lining up the side edges of the sheets 2 are movable so that they are simultaneously moved toward and away from both the reference surfaces L1 and L2, the lineup rods 21*a* and 21*b* can act on the sheets 2 in optimum positions according to the size of the sheets 2 handled. Further since the distance between the rods 21*a* and 21*b* becomes smaller as the rods 21*a* and 21*b* are moved toward the side edge of the sheet 2, the positions in which the rods 21*a* and 21*b* act on the sheets 2 can be further better.

Further by virtue of the hollow resilient members 38, which are brought into contact with the trailing edges of the sheet stacks 20 on the respective bins 4 in sequence each time the indexer 6 is moved upward, the trailing edges of the sheets 2 in each stack 20 are lined up better.

What is claimed is:

1. In a sheet sorter comprising a plurality of bins arranged in a vertical direction each of which receives a plurality of sheets discharged from an image recording apparatus and forms thereon a stack of sheets, a sheet transfer means which transfers the sheets discharged from the image recording apparatus, an indexer which is movable up and down along the array of sheet inlet ends of the bins to distribute the sheets from the sheet transfer means to the respective bins through the sheet inlet ends thereof, and a post handling means which is movable up and down along the array of the sheet inlet ends of the bins and carries out a predetermined post handling on the stack of sheets on each of the bins, a sheet stack ejector mechanism for ejecting the stack of sheets on each of the bins beyond the sheet inlet end of the bin by a predetermined length, thereby giving the post handling means access to the stack of sheets, comprising;

a guide rail which extends in a vertical direction through the bins, and a sheet stack ejector member which is mounted on the guide rail to be movable up and down along the guide rail and is adapted to eject the stacks of sheets on the respective bins one by one toward the post handling means.

2. A sheet stack ejector mechanism as defined in claim 1 in which said post handling means comprises a stapler which binds the stack of sheets.

3. A sheet stack ejector mechanism as defined in claim 1 in which said guide rail is movable toward the sheet inlet ends of the bins and said sheet stack ejector member is projected from the guide rail toward the sheet inlet ends by a distance not smaller than said predetermined length.

4. A sheet stack ejector mechanism as defined in claim 1 in which said guide rail doubles as a stopper which abuts against the leading edge of the sheet fed into the bin by the indexer and stops the sheet.

5. A sheet stack ejector mechanism as defined in any one of claims 1 to 4 in which said sheet stack ejector member is engaged with a surface of each bin and ejects the stack of sheets on the bin toward the post handling means under the guidance of the surface of the bin, the sheet stack ejector member being movable up and down along the guide rail in a position where the sheet stack ejector member is disengaged from the surface of the bin.

6. A sheet stack ejector mechanism as defined in claim 5 in which said sheet stack ejector member, which is held between adjacent bins, ejects the stack of sheets on the bin toward the post handling means.

7. A sheet stack ejector mechanism as defined in any one of claims 1 to 3 in which a stopper which abuts against the leading edge of the sheet fed into the bin by the indexer and stops the sheet is provided separately from said guide rail.

8. A sheet stack ejector mechanism as defined in claim 7 in which said sheet stack ejector member is engaged with a surface of each bin and ejects the stack of sheets on the bin toward the post handling means under the guidance of the surface of the bin, the sheet stack ejector member being movable up and down along the guide rail in a position where the sheet stack ejector member is disengaged from the surface of the bin.

9. A sheet stack ejector mechanism as defined in claim 8 in which said sheet stack ejector member, which is held between adjacent bins, ejects the stack of sheets on the bin toward the post handling means.

10. A sheet sorter comprising:

a plurality of bins arranged vertically with respect to one another, each of said bins having an opening formed therein and an inlet for receiving plural sheets discharged from an image forming apparatus;

a guide rail extending vertically through said openings;

an ejector member slidably mounted on said guide rail;

means for moving said ejector member in a direction to eject a stack of sheets from one of said bins.

* * * * *